US005184143A

United States Patent [19]

Marko

[11] Patent Number: 5,184,143

[45] Date of Patent: Feb. 2, 1993

[54] LOW PROFILE ANTENNA

[75] Inventor: Paul D. Marko, Pembroke Pines, Fla.

[73] Assignee: Motorola, Inc., Schaumburg, Ill.

[21] Appl. No.: 660,974

[22] Filed: Feb. 26, 1991

Related U.S. Application Data

[63] Continuation of Ser. No. 359,827, Jun. 1, 1989, abandoned.

[51] Int. Cl.[5] ..... H01Q 9/30

[52] U.S. Cl. ..... 343/749; 343/702; 343/830; 343/845; 343/848

[58] Field of Search ..... 343/749, 846, 848, 702, 343/700 MS, 841, 829, 831, 830, 843, 845, 847, 849

[56] References Cited

U.S. PATENT DOCUMENTS

| | | | |
|---|---|---|---|
| 3,050,730 | 8/1962 | Lamberty | 343/843 |
| 3,114,913 | 12/1963 | Alford | 343/795 |
| 4,063,246 | 12/1977 | Greiser | 343/700 MS |
| 4,157,548 | 6/1979 | Kaloi | 343/700 MS |
| 4,319,249 | 3/1982 | Evans et al. | 343/795 |
| 4,516,127 | 5/1985 | Siwiak | 343/702 |
| 4,625,212 | 11/1986 | Oda et al. | 343/702 |
| 4,641,366 | 2/1987 | Yokoyama et al. | 455/89 |
| 4,700,194 | 10/1987 | Ogawa et al. | 343/848 |
| 4,701,763 | 10/1987 | Yamamoto et al. | 343/702 |
| 4,724,443 | 2/1988 | Nysen | 343/700 MS |
| 4,924,237 | 5/1990 | Honda et al. | 343/848 |

FOREIGN PATENT DOCUMENTS

| | | | |
|---|---|---|---|
| 565660 | 11/1958 | Canada | 343/795 |

*Primary Examiner*—Michael C. Wimer
*Attorney, Agent, or Firm*—Juliana Agon

[57] ABSTRACT

A low profile antenna includes a rectangular driven element and a rectangular ground plate spaced from the driven element. A coaxial transmission has its center conductor connected to an end of the driven element and its ground connection connected to the end of the driven element spaced from the center conductor connection. An inductance is coupled between the coaxial cable shield and the ground plate.

6 Claims, 1 Drawing Sheet

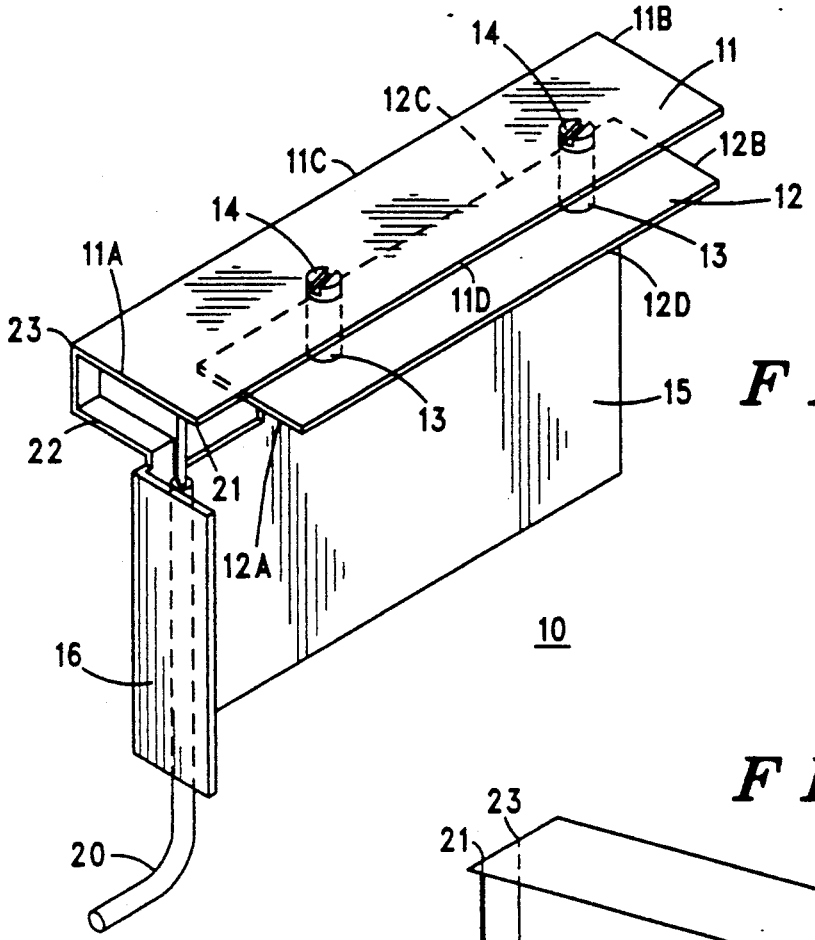
FIG. 1
FIG. 3
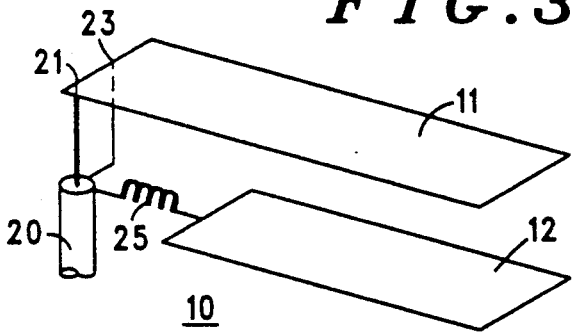
FIG. 2
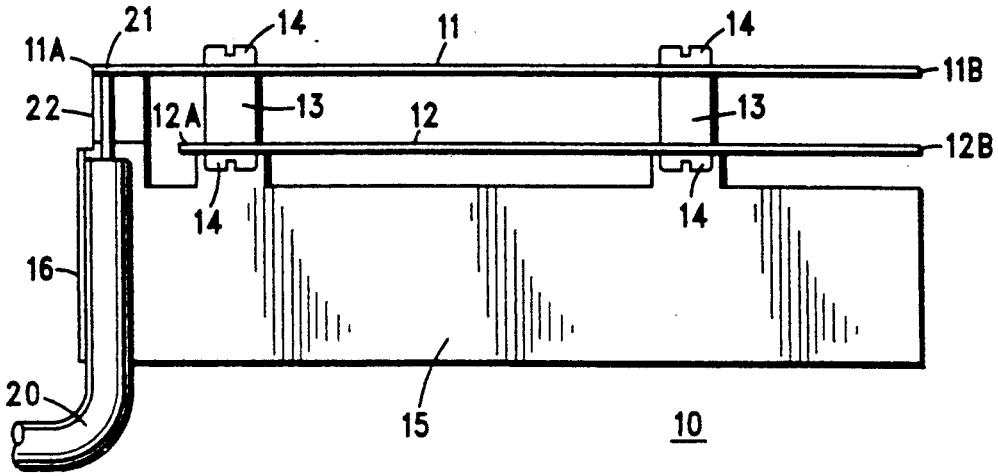

LOW PROFILE ANTENNA

This is a continuation of application Ser. No. 07/359,827, filed Jun. 1, 1989 and now abandoned.

BACKGROUND OF THE INVENTION

This invention relates to low profile antennas in general, and particularly to an antenna in which a radiating element is positioned spaced from a ground plate. Known feeding arrangements for such antennas involve feeding the antenna at points substantially spaced from the edges of the antenna plates. In one known antenna, a plurality of a conductive resonant posts are used for connecting the driven and ground plates of the antenna. In another known antenna, the ends of the radiating ground plates are shorted along the entire end.

SUMMARY OF THE INVENTION

This low profile antenna includes a driven element spaced from the ground plate where the driven element is fed at an end.

A low profile antenna includes a substantially rectangular driven element and a substantially rectangular ground plate spaced from the driven element. A feedpoint is located at an end of the driven element and a ground connection is located at the end of the driven element spaced from the feedpoint. In one aspect of the invention, the driven element has an aspect ratio greater than 3 to 1. In another aspect of the invention, a coaxial transmission line is coupled to the antenna. The coaxial transmission line center conductor is connected to the end of the driven element and inductive means couples the coaxial transmission line shield to the ground plate. In still another aspect of the invention, the ground plate has its corresponding end longitudinally spaced from the driven element feedpoint end.

BRIEF DESCRIPTION OF THE DRAWINGS

FIG. 1 is a perspective view of a low profile antenna in accordance with the present invention.

FIG. 2 is a side elevational view of the low profile antenna of FIG. 1.

FIG. 3 is perspective view of the low profile antenna showing the electrical equivalent circuit.

DESCRIPTION OF THE PREFERRED EMBODIMENT

Referring now by characters of reference to the drawings and first FIG. 1, it will be understood that the low profile antenna 10 includes a substantially rectangular elongated driven element 11 and a substantially rectangular elongated ground plate 12 spaced from the driven element 11. As is more clearly shown in FIG. 2, dielectric stand-offs 13 are used to mount the driven element 11 to the ground plate 12 and are affixed as by screws 14. The driven element 11 and ground plate 12 are thin metal plate like members having an aspect ratio at least 3 to 1 and preferably about 4 to 1. That is, they are approximately at least 3 and preferably about 4 times greater in length than width.

The driven element 11 includes a driven end or edge 11*a*, an opposed end or edge 11*b*, and opposed side edges 11*c* and 11*d*. Similarly, the ground plate 12 includes opposed ends 12*a* and 12*b* and opposed sides 12*c* and 12*d*. The planes of driven element 11 and ground plate 12 are substantially parallel while edges 11*c* and 12*c* and 11*d* and 12*d* are preferably aligned. Edge 11*a* extends beyond edge 12*a* while edge 12*b* can be coextensive with edge 11*b* or alternatively can be shorter or extend beyond edge 11*b* based upon the physical constraints as the antenna is designed to be mounted within a housing. A metal shield or plate 15 extends perpendicular from the lower side of ground plate 12. Shield 15 is attached to the ground plate 12 for providing an electrical ground connection to the ground plate. The shield 15 includes an end portion 16 that is turned at a 90 degree angle and is approximately aligned with the driven element edge 11*a*.

A transmission line, such as coaxial cable 20 is utilized for providing an RF connection to the antenna 10. The coaxial cable 20 has its center connector connected to the driven element 11 at a point 21 which is substantially at the edge 11*a*, while its shield connection is connected to the end portion 16 of shield 15. Shield 15 provides an electrical connection between the ground shield of cable 20 and the ground plate 12 which is inductive. A ground connection is made between the shield of cable 20 and the driven element 11 as by a grounding strap 22. Strap 22 extends between the plate 15 and a ground point 23 substantially at the edge 11*a*. While this particular grounding point 23 is illustrated as being at the side 11*c*, it can be made closer to the feedpoint 21, provided that it is made at edge 11*a*. The distance between the points 21 and 23 is selected to provide the appropriate impedance match to the coaxial cable 20, such as 50 ohms.

Referring to FIG. 3, in operation, the resonant frequency of the antenna 11 is determined substantially by the length of the driven element 11. The length is chosen so that the antenna acts as a quaterwave resonator. The driven element 11 is end fed, with an inductance (25) provided by shield 15 between the shield side of the coaxial cable 20 and the ground plate 12. The inductance 25 lowers the resonant frequency of the antenna, thereby reducing the required length at a given operating frequency.

An antenna 10 covering the UHF frequency range of 440–470 MHz can be constructed by providing a driven element 11 having a width of 1.15 and a length of 4.6 inches. The ground plate 12 is 1.15 inches by 4.9 inches. The distance between driven element 11 and ground plate 12 is 0.4 inches. At an operating frequency of 450 MHz, 0.4 inches translates to substantially 0.015 of a free space wavelength (where wavelength $=c/f=[(3\times10^8 m/s)/(450\times10^6(1/s))]$ (100 cm/m)(1 in/2.54 cm)=26 inches). Points 21 and 23 are 0.7 inches apart on edge 11*a*. Edge 12*a* is longitudinally displaced from edge 11*a* by 0.27 inches. In this example edge 12*b* extends beyond edge 11*a*. The dimensions utilized must take into consideration the dielectric loading effects of the housing in which it is mounted. The antenna is particularly useful for two-way portable radio data products, but can be utilized with other radio devices.

I claim as my invention:

1. A low profile antenna comprising:

a substantially rectangular driven plate having a first and a second connection located along an edge of the width thereof, a substantially rectangular ground plate spaced parallel from the driven plate, a feedpoint located at said first connection along said edge of the driven plate, a coaxial transmission line is coupled to the antenna, the coaxial transmission line center conductor is connected to the edge of the driven plate, inductive means located underneath and parallel to the driven plate couples the coaxial transmission line shield to the ground plate, and ground connecting means connected to the coaxial transmission line shield and to said edge of the driven plate at said second connection spaced from the feedpoint.

2. A low profile antenna as defined in claim 1, in which:

the driven plate has an aspect ratio greater than 3 to 1.

3. A low profile antenna as defined in claim 2, in which:

the aspect ratio is approximately 4 to 1.

4. A low profile antenna as defined in claim 1, in which:

the ground plate has an edge closest to the driven plate feedpoint edge and longitudinally spaced from the driven plate feedpoint edge.

5. The low profile antenna of claim 1 wherein said substantially rectangular ground plate has a distance that is substantially 0.015 of a free space wavelength spaced parallel from the driven plate.

6. A low profile antenna for a radio comprising:

a substantially rectangular and driven plate having a first and a second connection located along a feedpoint width edge of the width thereof to form a feedpoint side of said antenna, a substantially rectangular ground plate spaced below said driven plate, said driven and ground plates separately disposed in parallel planes, a feedpoint located at said first connection along said width edge of the driven plate, a transmission line, having a transmission line conductor and a transmission line ground conductor, coupled to the antenna, the transmission line conductor connected to the width edge of the driven plate, a metal shield having a shield plate and an angled end portion, said shield plate being located underneath and having a plane perpendicular to the driven plate and, at said feedpoint side, said angled end portion being approximately aligned in parallel with said feedpoint width edge, said metal shield coupling the transmission line ground conductor to the ground plate, and ground connecting means connected to said metal shield approximately at said feedpoint side and to said edge of the driven plate at said second connection spaced from the feedpoint.

* * * * *